United States Patent [19]

Wheeler et al.

[11] Patent Number: 4,995,786

[45] Date of Patent: Feb. 26, 1991

[54] DUAL VARIABLE CAMBER COMPRESSOR STATOR VANE

[75] Inventors: Jerry W. Wheeler, Holland, Pa.; Walter H. Wiley, III, Palm Beach Gardens, Fla.

[73] Assignee: United Technologies Corporation, Hartford, Conn.

[21] Appl. No.: 413,574

[22] Filed: Sep. 28, 1989

[51] Int. Cl.[5] ..... F01D 17/08; F01D 17/12

[52] U.S. Cl. ..... 415/148; 415/148

[58] Field of Search ..... 415/148, 150, 151, 154.3, 415/155, 159, 160, 161, 162

[56] References Cited

U.S. PATENT DOCUMENTS

| | | | |
|---|---|---|---|
| 2,805,818 | 9/1957 | Ferri | 415/148 |
| 2,914,241 | 11/1959 | Novak | 415/162 |
| 2,930,579 | 9/1960 | Boyd et al. | 415/160 |
| 3,442,493 | 5/1969 | Smith | 415/164 |
| 3,887,297 | 6/1975 | Welchek | 415/148 |
| 4,634,340 | 1/1987 | Stetter | 415/161 |
| 4,773,817 | 9/1988 | Stangalini et al. | 415/160 |

*Primary Examiner*—Carl D. Price
*Assistant Examiner*—Hoang Nguyen
*Attorney, Agent, or Firm*—Russell M. Lipes, Jr.

[57] ABSTRACT

A compressor stator vane for a gas turbine engine comprised of a leading edge section and a trailing edge section and constructed so that either or both sections may be rotated about a common axis of rotation to vary vane camber with torque for rotating the sections being applied around the engine perimeter.

6 Claims, 5 Drawing Sheets

FIG. 4
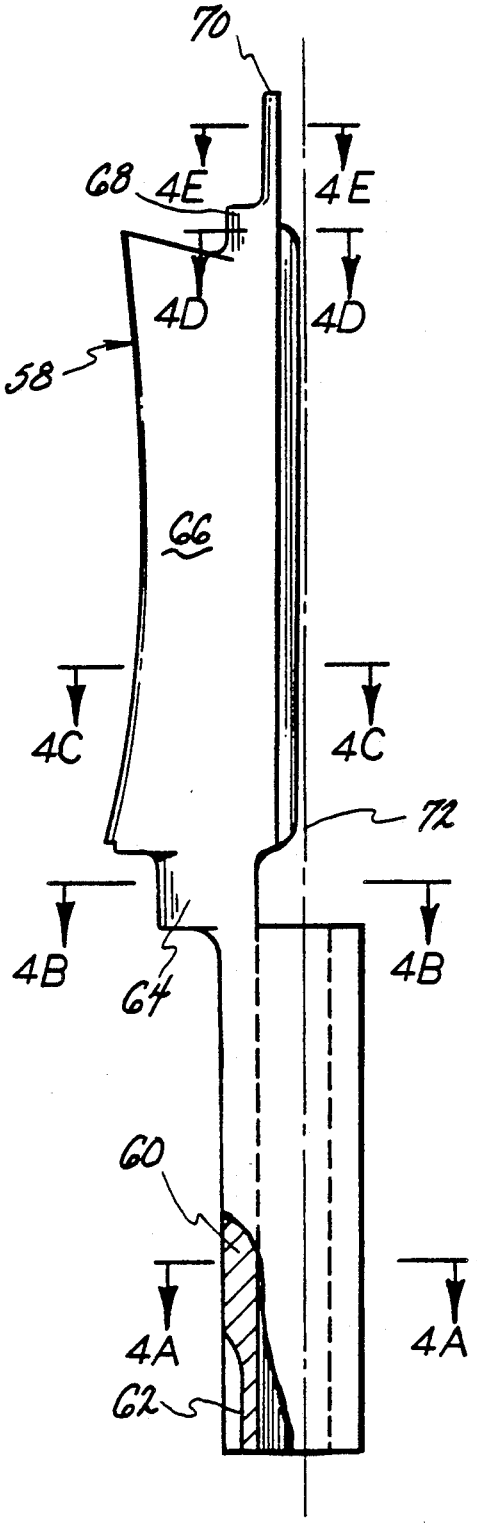
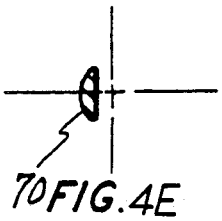
FIG. 4E
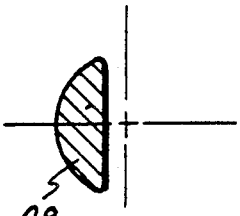
FIG. 4D
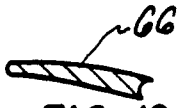
FIG. 4C
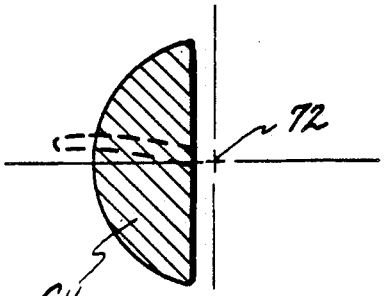
FIG. 4B
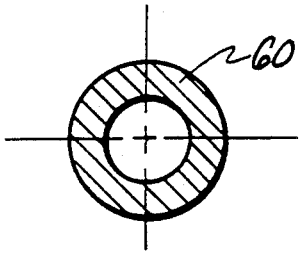
FIG. 4A FIG. 5
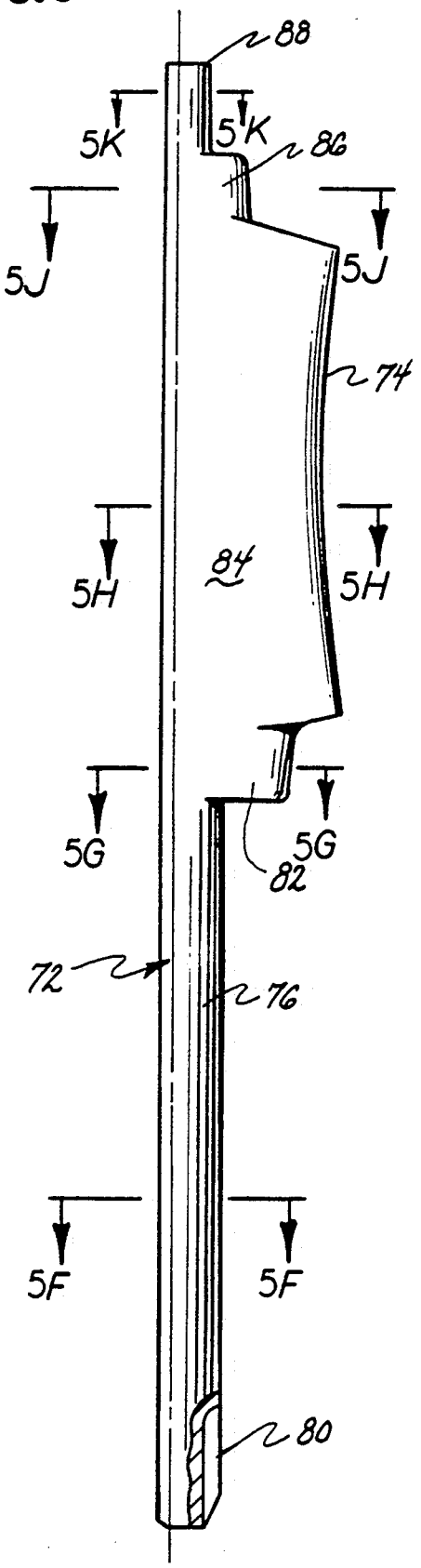
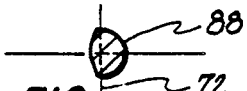
FIG. 5K
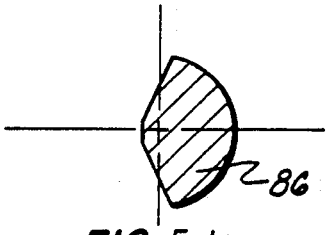
FIG. 5J
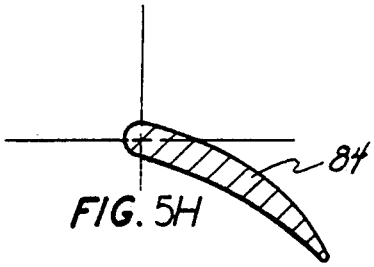
FIG. 5H
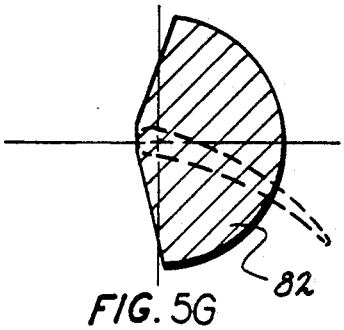
FIG. 5G
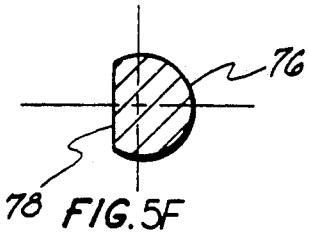
FIG. 5F

DUAL VARIABLE CAMBER COMPRESSOR STATOR VANE

TECHNICAL FIELD

This invention relates to compressor stator vanes for axial flow gas turbine engines.

BACKGROUND ART

The compressors of some current axial flow gas turbine engines utilize variable stator vanes involving a construction wherein either a leading edge portion or a trailing edge portion of a vane or the entire airfoil of the vane is rotated about an axis to vary the flow characteristics of the compressor.

Ferri U.S. Pat. No. 2,805,818, Tyler U.S. Pat. No. 3,318,574 and Welcheck U.S. Pat. No. 3,887,297 are directed to gas turbine engine stator vanes having a moveable upstream portion and a fixed downstream portion. Novak U.S. Pat. No. 2,914,241 and Smith U.S. Pat. No. 3,442,493 are directed to gas turbine engine stator vanes having a moveable downstream portion and a fixed upstream portion. Dittie U.S. Pat. No. 4,558,987 is directed to a compressor in which two rows of guide vanes are adjusted in tandem.

DISCLOSURE OF INVENTION

According to the present invention, an axial flow gas turbine engine is provided with means for simultaneously varying both the leading edge and the trailing edge of the vanes in a row of compressor stator vanes. As a result of the dual control of stator vane camber, compressor performance at "off design" operating conditions is improved, airflow capability is enhanced, and there is the ability to vary airflow while holding rotor speed essentially constant.

The desire to vary both the leading and trailing edges of stator vanes simultaneously can give rise to some mechanical problems, particularly in the drive/actuation means, support of the vanes at the compressor outer cases, the intersection of the mating halves of the stator vane airfoil sections, and the inner diameter support at the compressor shroud. The construction of this invention is believed to avoid those problems.

An object of this invention is to provide mechanical means for simultaneously varying both the leading edge and the trailing edge of stator vanes for an axial flow compressor.

Still another object of the invention is the provision of a construction for varying stator vane camber through simultaneous adjustment of the position of leading and trailing edge sections of the vanes using torque transmitting features which are outboard of the flowpath where size of the vane airfoil is not a concern.

The foregoing and other objects, features and advantages will be apparent from the specification and claims and from the accompanying drawings which illustrate an embodiment of the invention.

BRIEF DESCRIPTION OF THE DRAWINGS

FIG. 4 shows a leading edge section of a stator vane with cross-sections through certain areas of section.

FIG. 4A is a section view taken along line 4A—4A in FIG. 4.

FIG. 4B is a section view taken along line 4B—4B in FIG. 4.

FIG. 4C is a section view taken along line 4C—4C in FIG. 4.

FIG. 4D is a section view taken along line 4D—4D in FIG. 4.

FIG. 4E is a section view taken along line 4E—4E in FIG. 4.

FIG. 5 shows a trailing edge section of a stator vane with cross-sections through certain areas of the section.

FIG. 5F is a section view taken along line 5F—5F in FIG. 5.

FIG. 5G is a section view taken along line 5G—5G in FIG. 5.

FIG. 5H is a section view taken along line 5H—5H in FIG. 5.

FIG. 5J is a section view taken along line 5J—5J in FIG. 5.

FIG. 5K is a section view taken along line 5K—5K in FIG. 5.

BEST MODE FOR CARRYING OUT THE INVENTION

Figure 1:
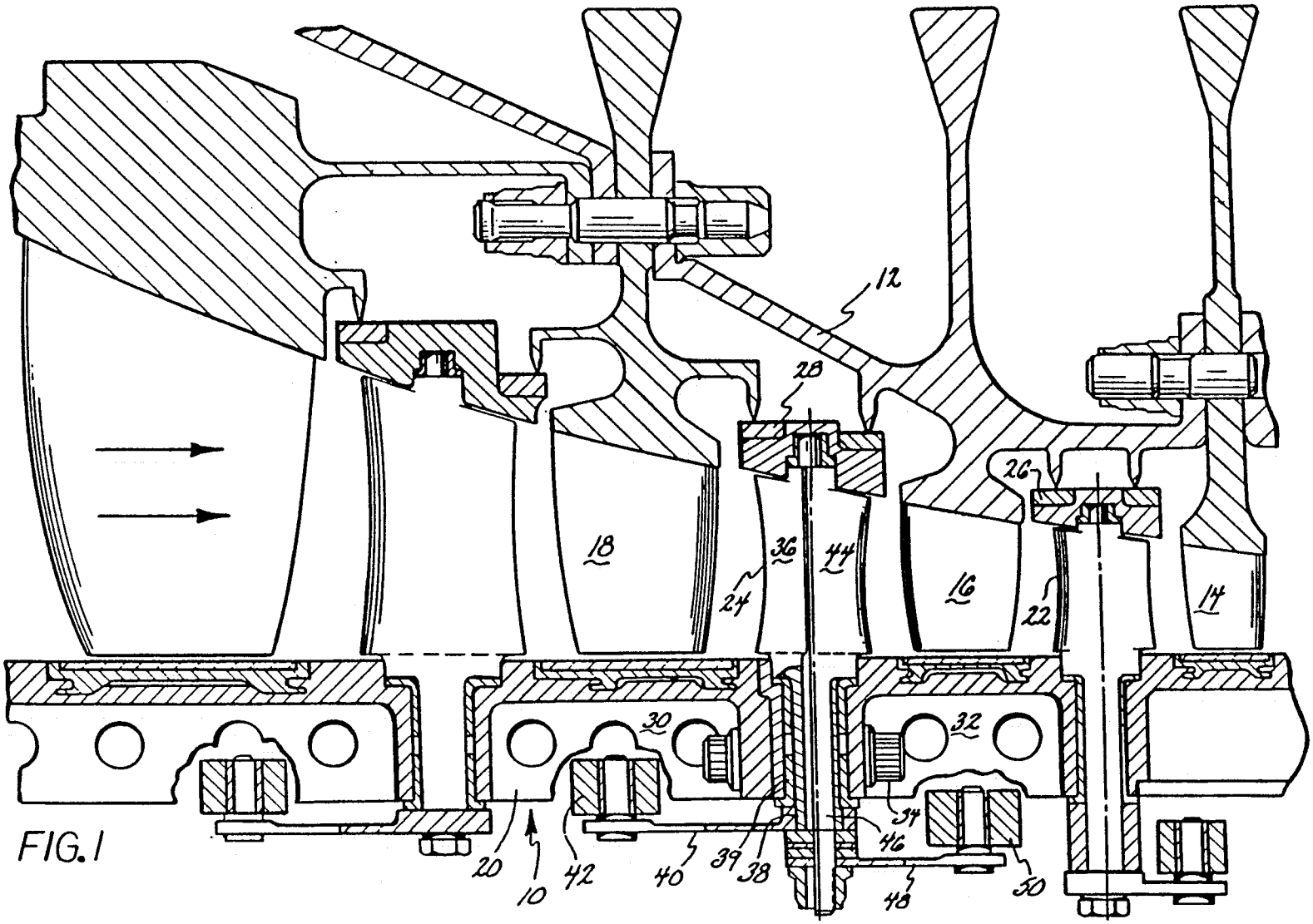
FIG. 1 is a cross-sectional view of a portion of an axial flow gas turbine engine compressor having at least one row or stage of stator vanes constructed in accordance with the invention.

In FIG. 1, 10 generally indicates an axial flow gas turbine engine compressor having rotor 12 with rows of compressor blades 14, 16 and 18 thereon, and outer casing 20 surrounding the rotor. Alternating with the rows of compressor blades are rows of stator vanes such as vanes 22 between blades rows 14 and 16 and vanes 24 between blade rows 16 and 18. Each row of vanes supports a circular segmented inner casing or shroud such as shroud 26 supported by vanes 22 and shroud 28 supported by vanes 24. Outer casing 20 is comprised of a number of split circular sections, such as 30 and 32, which are bolted together as by bolts 34 located in circular case flanges and bolts 35 located in axial split flanges.

Figure 2:
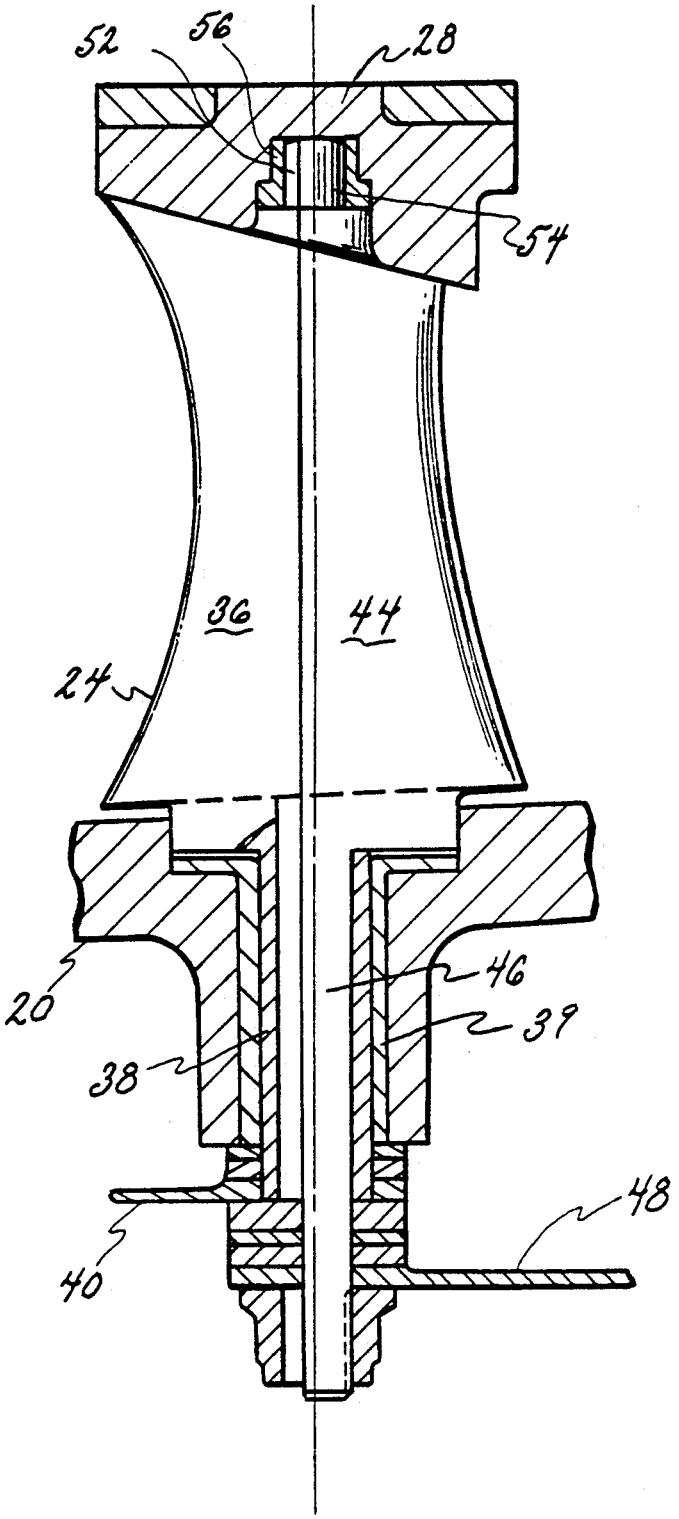
FIG. 2 is an enlarged view of one of the stator vanes in the compressor of FIG. 1 showing details of the construction.

The stator vanes, as shown in FIGS. 1 and 2 include a leading edge section and a trailing edge section and each section has a shaftlike portion extending upward through the outer casing for connection to a vane section position adjusting system. For example, vane 24 has leading edge section 36 having annular extension 38 projecting through bushing 39 and outer casing 20 and connected to torque drive arm 40 on the perimeter of the outer casing. The drive arm is connected to synchronization ring 42 surrounding the engine as are all the other vane drive arms connected to the leading edge sections of the vanes in the row of vanes 24. Circumferential movement of the synchronization ring simultaneously adjusts the position of the leading edge sections of vanes 24.

Vane 24 also has trailing edge section 44 having stem 46 adapted to fit within leading edge section annular extension 38 and projecting through outer casing 20. The stem is connected to torque drive arm 48 on the perimeter of outer casing 20. The drive arm is connected to synchronization ring 50 surrounding the engine as are all the other vane drive arms connected to the trailing edge sections of the vanes in the row of vanes 24. Circumferential movement of the synchronization ring simultaneously adjusts the position of the trailing edge sections of vanes 24. Shaftlike projection 52 on the inner end of leading edge section 36 and shaftlike projection 54 on the inner end of trailing edge section 44 fit within and are supported by bushing 56 located in inner casing 28. The bushing serves both as a surface of rotation and as a means to hold the blade sections together both axially and radially.

Figure 3:
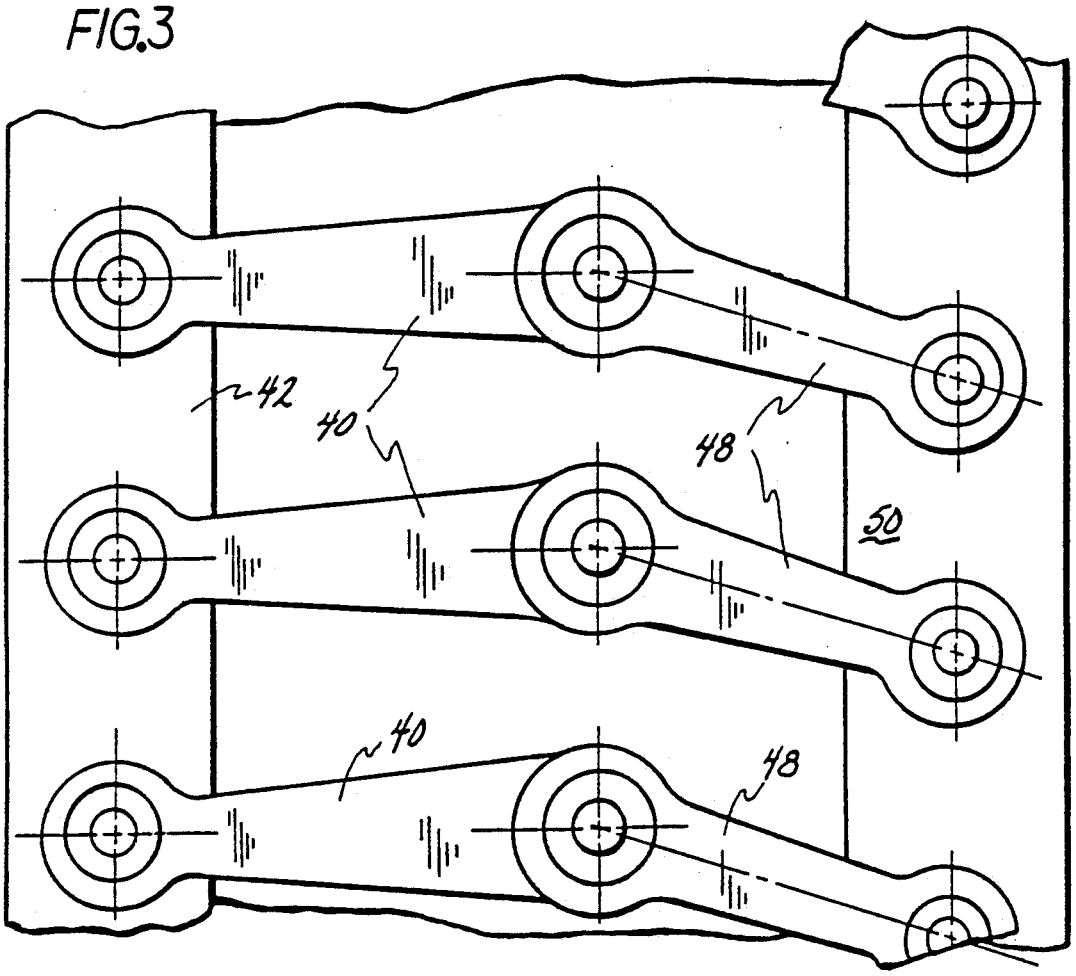
FIG. 3 is a top view of a portion of the engine casing shown in FIG. 1 showing the two sets of synchronization rings and vane arms for one row or stage of stator vanes.

FIG. 3 shows a portion of the two sets of synchronization rings and vane drive arms required for each vane row or stage. While the synchronization rings are shown located fore and aft of each other, they could be located concentric with each other, one radially outward from the other. Leading edge section drive arms 40 are connected to synchronization ring 42, and trailing edge section drive arms 48 are connected to synchronization ring 50. The circumferential position of the two synchronization rings is controlled so as to independently or in combination vary the position of the vane leading and trailing edge sections and thus the camber of the vanes.

FIG. 4 shows the leading edge section of a stator vane with cross-sections through significant portions of the edge section. Leading edge section 58 has shaft portion 60 which would extend through the outer casing and which as shown by cross-section 4A—4A of FIG. 4A is annular in shape. The shaft portion has flat 62 at its upper, outer end for attachment of a drive arm. Portion 64 of the section connecting shaft portion 60 to airfoil portion 66 is essentially semi-circular in shape as shown by cross-section 4B—4B of FIG. 4B. Airfoil portion 66 is slightly cambered in shape as shown by cross-section 4C—4C of FIG. 4C. Portion 68 at the inner end of the vane section is essentially semi-circular in shape as shown by cross-section 4D—4D of FIG. 4D and connects airfoil portion 66 to shaftlike projection 70 which also is essentially semi-circular in shape as shown by cross-section 4E—4E of FIG. 4E.

FIG. 5 shows the trailing edge section of a stator vane with cross-sections through significant portions of the edge section. The axis of rotation for the vane sections of FIGS. 4 and 5 is shown at 72. Trailing edge section 74 has stem 76 adapted to fit within annular shaft portion 60 of leading edge section 58 shown in FIG. 4. Stem 76, as shown in cross-section 5F—5F of FIG. 5F, is somewhat less than circular in cross-section since one side, 78, must be flattened to provide clearance, to permit limited rotation of the leading edge section with respect to the trailing edge section of the vane, and permit assembly of the leading and trailing edge sections to form a vane. Flat 80 at the upper, outer end is provided for attachment of a drive arm. Portion 82 of the section connecting stem 76 to airfoil portion 84 is shaped like a sector as shown by cross-section 5G—5G of FIG. 5G to accommodate limited rotational movement of the leading and trailing edge sections. It also provides structural attachment of airfoil portion 84 to the stem and "fills" the flowpath on the inner surface of the outer casing. Airfoil portion 84 is cambered in shape as shown by cross-section 5H—5H of FIG. 5H.

Portion 86 at the inner end of the vane section is shaped like a sector as shown by cross-section 5J—5J of FIG. 5J and connects airfoil portion 84 to shaftlike projection 88 which also is shaped like a sector as shown by cross-section 5K—5K of FIG. 5K. Each of the portions 82, 84 and 86 and projection 88 is formed in its area adjacent axis of rotation 72 to provide clearance and permit limited rotation of the trailing edge section with respect to the leading edge section of the vane.

It should be understood that the invention is not limited to the particular embodiment shown and described herein, but that various changes and modifications may be made without departing from the spirit or scope of the concept as defined by the following claims.

We claim:

1. A compressor stator vane for a gas turbine engine, said vane having a leading edge section and a trailing edge section, each section having a shaftlike portion extending through the outer casing of said engine, a shaftlike projection supporting an inner shroud of said engine, and an airfoil portion between said shaftlike portion and said shaftlike projection, means connected to the shaftlike portion of each edge section for adjusting the position of each edge section, and control means connected to said section adjusting means to actuate said section adjusting means and vary the camber of said vane.

2. A stator vane in accordance with claim 1 in which the shaftlike portion of the trailing edge section is fitted within the shaftlike portion of the leading edge section.

3. A stator vane in accordance with claim 1 in which the engine includes at least one stage of vanes and the control means include first synchronizing means connected to each adjusting means for the vane leading edge sections and second synchronizing means connected to each adjusting means for the vane trailing edge sections.

4. A compressor vane in accordance with claim 1 in which the leading edge section and the trailing edge section have a common axis of rotation for varying vane camber.

5. A compressor vane in accordance with claim 1 in which the shaftlike portion of the leading edge section is annular in form and the shaftlike portion of the trailing edge section is essentially circular in form and adapted to fit within the leading edge section annular shaft portion.

6. A compressor vane in accordance with claim 1 in which the shaftlike projection of the leading edge section has essentially a semi-circular shape and the shaftlike projection of the trailing edge section has a sector shape.

* * * * *